US010124459B2

(12) United States Patent
Kojima et al.

(10) Patent No.: US 10,124,459 B2
(45) Date of Patent: Nov. 13, 2018

(54) LENS-CENTERING METHOD FOR SPHERICAL CENTER-TYPE PROCESSING MACHINE, LENS-PROCESSING METHOD, AND SPHERICAL CENTER-TYPE PROCESSING MACHINE

(71) Applicant: KOJIMA ENGINEERING CO., LTD., Kamiina-gun, Nagano (JP)

(72) Inventors: Hideo Kojima, Nagano (JP); Hiroshi Fukuzawa, Nagano (JP)

(73) Assignee: Kojima Engineering Co., Ltd., Kamiina-gun, Nagano (JP)

( * ) Notice: Subject to any disclaimer, the term of this patent is extended or adjusted under 35 U.S.C. 154(b) by 234 days.

(21) Appl. No.: 15/304,939

(22) PCT Filed: Apr. 25, 2014

(86) PCT No.: PCT/JP2014/061761
§ 371 (c)(1),
(2) Date: Oct. 18, 2016

(87) PCT Pub. No.: WO2015/162789
PCT Pub. Date: Oct. 29, 2015

(65) Prior Publication Data
US 2017/0182622 A1 Jun. 29, 2017

(51) Int. Cl.
*B24B 13/02* (2006.01)
*B24B 13/005* (2006.01)
*B24B 51/00* (2006.01)

(52) U.S. Cl.
CPC ..... *B24B 13/02* (2013.01); *B24B 13/0055* (2013.01); *B24B 51/00* (2013.01)

(58) Field of Classification Search
CPC ... B24B 13/005; B24B 13/0055; B24B 13/01; B24B 13/02; B24B 13/06; B24B 51/00
See application file for complete search history.

(56) References Cited

U.S. PATENT DOCUMENTS 2,105,175 A * 1/1938 Anderson ..... B24B 13/02 351/178
3,900,972 A * 8/1975 Rupp ..... B24B 13/02 451/270

(Continued)

FOREIGN PATENT DOCUMENTS

JP 2001-225265 A 8/2001
JP 2010-184340 A 8/2010

(Continued)

OTHER PUBLICATIONS

International Search Report (PCT/ISA/210) dated May 27, 2014, by the Japanese Patent Office as the International Searching Authority for International Application No. PCT/JP2014/061761.

*Primary Examiner* — Timothy V Eley
(74) *Attorney, Agent, or Firm* — Buchanan Ingersoll & Rooney PC

(57) ABSTRACT

According to this lens-centering method, a state in which a lens is sandwiched at prescribed pressing force between a lens holder and a lens processing dish is brought about. Next, the lens-processing dish is rotated at slow speed about a rotation axis line that passes through the center and the spherical center of the lens-processing surface thereof, and is made to oscillate at a slight angle about the spherical center of the lens-processing surface as the center of oscillating action. The spherical center of a first lens spherical surface of the lens is guided to the spherical center of a lens-retaining surface of the lens holder, and the spherical center of a second lens spherical surface is guided to the spherical center of the lens-processing surface. A lens mounted in the spherical center-type processing machine can be set to an accurately centered state thereby.

10 Claims, 4 Drawing Sheets

(56) References Cited

U.S. PATENT DOCUMENTS

| | | | | | |
|---|---|---|---|---|---|
| 3,916,574 | A * | 11/1975 | Prunier | B24B 13/02 | 451/277 |
| 4,085,553 | A * | 4/1978 | Prunier | B24B 13/005 | 451/390 |
| 4,653,234 | A * | 3/1987 | Lombard | B24B 13/02 | 451/390 |
| 6,074,281 | A * | 6/2000 | Swanson | B24B 1/00 | 451/166 |
| 2012/0045975 | A1* | 2/2012 | Kojima | B24B 13/02 | 451/294 |
| 2012/0289127 | A1* | 11/2012 | Kojima | B24B 13/02 | 451/42 |
| 2013/0130599 | A1* | 5/2013 | Miyazaki | B24B 13/01 | 451/59 |
| 2015/0024663 | A1* | 1/2015 | Torikai | B24B 13/005 | 451/42 |
| 2017/0246729 | A1* | 8/2017 | Philipps | B24B 13/012 | |

FOREIGN PATENT DOCUMENTS

| | | | |
|---|---|---|---|
| JP | 5453459 | B2 | 3/2014 |
| WO | WO 2011/092748 | A1 | 8/2011 |

* cited by examiner

LENS-CENTERING METHOD FOR SPHERICAL CENTER-TYPE PROCESSING MACHINE, LENS-PROCESSING METHOD, AND SPHERICAL CENTER-TYPE PROCESSING MACHINE

TECHNICAL FIELD

The present invention relates to a lens-centering method for mounting a lens to be precision-ground or polished in a centered manner between a lens holder and a lens-processing dish of a spherical center-type processing machine, a lens-processing method for performing precision grinding or polishing on the lens mounted according the centering method, and a spherical center-type processing machine in which this lens-processing method is used.

BACKGROUND ART

In a spherical center-type processing machine, the spherical lens surface of a spherical-surface lens retained in a lens holder is pressed with a prescribed pressing force against a lens-processing dish (polishing dish), and in this state, the lens-processing dish is made to rotate and oscillate to precision-grind or polish the spherical lens surface, as is described in Patent Document 1. When precision grinding or polishing is performed on the spherical lens surface, the lens to be processed must be mounted as being centered between the lens holder and the lens-processing dish.

In other words, the lens must be mounted in a centered state in which a straight line joining the spherical centers of the spherical lens surfaces on both sides of the lens coincides with a straight line joining the spherical center of the spherical-surface-shaped lens-retaining surface of the lens holder and the spherical center of the spherical-surface-shaped lens-processing surface of the lens-processing dish. Lateral movement of the lens being processed must also be prevented so that the lens can be processed while remaining centered.

Therefore, an edge receiver is provided to the lens holder so as to enclose the outer peripheral edge of the lens-retaining surface. When the lens is retained in the lens-retaining surface, the edge, which is the lens circle's outer peripheral end surface, fits into the inner peripheral surface of the edge receiver, and the lens will be centered relative to the lens holder by the edge receiver.

Edgeless lenses can also be processed. In the case that an edgeless lens will be processed, there must be an operation such as affixing the lens to the lens-retaining surface of the lens holder with the lens centered.

Patent Document 1: JP 5453459 B

DISCLOSURE OF THE INVENTION

Problems to be Solved by the Invention

In this case, the edge shape, i.e., the outer peripheral surface shape of the lens to be precision-ground or polished is typically not a perfect circle, but has much nonuniformity in the outside-diameter dimension. Therefore, in conventional practice, to enable a to-be-processed lens having nonuniformity in the outside-diameter dimension to be mounted in a lens-retaining surface enclosed by an edge receiver in a lens holder, the inside-diameter dimension of the circular inner peripheral surface of the edge receiver is made slightly larger than the edge outside-diameter dimension of the lens to be processed. Therefore, with the lens retained in the lens holder, a tiny gap is sometimes left between the lens edge and the edge receiver.

When a gap is created, there is a risk of slight misalignment between the spherical center of the lens-retaining surface of the lens holder and the spherical center of the spherical surface of the lens in contact with the lens-retaining surface, when the lens is mounted in the lens holder. In the event of such spherical center misalignment, processing in the processing steps (precision-grinding step, polishing step) is performed with the lens pressed against the lens-processing surface of the lens-processing dish while rotating eccentrically, and the spherical lens surface on the processed side will not be a perfect sphere.

There is also a risk that the state of interference between the lens outer peripheral surface and the edge receiver inner peripheral surface will change between the processing of one spherical lens surface and the processing of the other spherical lens surface. In this case, there is a risk of misalignment in the center axis lines (the lens optical axis) of the spherical lens surfaces on both sides after processing.

When a spherical lens surface is thus precision-ground or polished using a spherical center-type processing machine having a lens holder with an edge receiver, there is a risk that the precision of processing the spherical lens surface will decrease.

During the processing of the spherical lens surface of an edgeless lens, an extra step is needed to accurately affix the lens in a centered state in the lens holder. To improve operative efficiency in lens processing, such a step is preferably omitted.

In view of these matters, an object of the present invention is to provide a lens-centering method for a spherical center-type processing machine, whereby a lens to be processed can be mounted between a lens holder and a lens-processing dish in an accurately centered state without using an edge receiver and without the need for an operation of affixing the lens to the lens holder. Another object is to provide a lens-processing method for precision-grinding or polishing a lens centered by this lens-centering method. Yet another object is to provide a spherical center-type processing machine with which the lens-processing method can be used to precision-grind or polish the spherical lens surface of a lens with precision.

Means to Solve the Problems

To solve the problems described above, according to the present invention, there is provided a centering method for mounting a lens in a centered state between a lens holder and a lens-processing dish of a spherical center-type processing machine in order to precision-grind or polish a spherical lens surface of the lens, said centering method characterized by comprising:

a lens-chucking step of vacuum-chucking the lens to the lens holder;

a lens-pressing step of pressing the spherical lens surface of the lens with a prescribed pressing force to a lens-processing surface having a spherical-surface shape corresponding to the spherical lens surface in the lens-processing dish;

a lens-unchucking step of unchucking of the lens; and a rotation/oscillation step of guiding the spherical center of the spherical lens surface to the spherical center of the lens-processing surface by rotating the lens-processing dish, with the lens pressed against the dish at said pressing force, at a prescribed rotational speed about a rotational axis line passing through the center of the lens-processing surface and a spherical center positioned on the center axis line of the lens holder in the lens-processing surface, and causing the lens-processing dish to oscillate at a prescribed oscillation angle in a prescribed direction about the spherical center as the center of oscillating action.

The present invention is also directed to a centering method for causing a lens in which a first spherical lens surface is formed on one surface and a second spherical lens surface is formed on the other surface to be mounted in a centered state between a lens holder and a lens-processing dish of a spherical center-type processing machine in order to precision-grind or polish the second spherical lens surface of the lens, the centering method characterized by comprising:

a lens-chucking step of vacuum-chucking the first spherical lens surface of the lens to a lens-retaining surface having a spherical-surface shape corresponding to the first spherical lens surface in the lens holder;

a lens-pressing step of pressing the second spherical lens surface of the lens, which is chucked to the lens-retaining surface, with a prescribed pressing force to a lens-processing surface having a spherical-surface shape corresponding to the second spherical lens surface in the lens-processing dish;

a lens-unchucking step of unchucking of the lens on the lens-retaining surface; and a rotation/oscillation step of guiding the spherical center of the first spherical lens surface to the spherical center of the lens-retaining surface and guiding the spherical center of the second spherical lens surface to the spherical center of the lens-processing surface, by rotating the lens-processing dish, with the lens pressed against the dish at said pressing force, at a prescribed rotational speed about a rotational axis line passing through the center of the lens-processing surface and a spherical center of the lens-processing surface, and causing the lens-processing dish to oscillate at a prescribed oscillation angle in a prescribed direction about the spherical center of the lens-processing surface as the center of oscillating action.

In this spherical center-type processing machine, the lens holder and the lens-processing dish sandwich the lens to be processed, and these two components come to be facing each other in a state being positioned. In other words, the spherical center of the lens-processing surface of the lens-processing dish is positioned on the center axis line of the lens holder (a straight line passing through the center and spherical center of the lens-retaining surface), and the lens-processing dish oscillates about the spherical center as the center of oscillation. In the centering method of the present invention, attention is directed to the lens-retaining surface of the lens holder and the lens-processing surface of the lens-processing dish, which are positioned in this manner, and, utilizing the spherical-surface shapes thereof, a centered state is brought about in which a straight line joining the spherical centers of the spherical lens surfaces on both sides of the lens to be processed coincides with a straight line joining the spherical center of the lens-retaining surface and the spherical center of the lens-processing surface.

In other words, the lens to be processed is sandwiched with a prescribed pressing force between the positioned lens-retaining surface and lens-processing surface, and the rotation/oscillation step, in which the lens-processing dish is rotated at a prescribed rotational speed and the lens-processing dish is made to oscillate at a prescribed oscillation angle, is performed in this state. Due to sliding that occurs with this rotation and oscillation, the lens, sandwiched in a movable state between the lens-retaining surface and the lens-processing surface, automatically moves to the most mechanically stable position.

In other words, when the surface of the lens on the lens holder side is flat, the spherical center of the spherical lens surface on the lens-processing dish side is guided by the lens-processing surface in a direction toward the spherical center of the lens-processing surface, and a centered state is brought about. In the case of a lens in which both sides are spherical lens surfaces, the spherical center of the first spherical lens surface of the lens is guided by the lens-retaining surface in a direction toward the spherical center of the lens-retaining surface, and the spherical center of the second spherical lens surface is guided by the lens-processing surface in a direction toward the spherical center of the lens-processing surface. As a result, a centered state is brought about in which a straight line joining the spherical centers of the spherical lens surfaces on both sides of the lens to be processed coincides with a straight line joining the spherical center of the lens-retaining surface and the spherical center of the lens-processing surface.

For the lens to be capable of automatically moving quickly to the centered position, in the rotation/oscillation step, it is preferable that the pressing force be less than the processing pressing force during the precision grinding or polishing of the spherical lens surface (the second spherical lens surface) of the lens, the rotational speed be slower than the processing rotational speed during the precision grinding or polishing of the spherical lens surface (the second spherical lens surface), and the oscillation angle be less than the processing oscillation angle during the precision grinding or polishing of the spherical lens surface (the second spherical lens surface).

Particularly, it is preferable that the pressing force be $1/5$ to $1/2$ of the processing pressing force, the rotational speed be 100 to 500 rpm, and the oscillation angle be $1/30$ to $1/10$ of the opening angle of the spherical lens surface from the center axis line.

According to the present invention, because there is no need to center the lens using a lens holder provided with an edge receiver, a lens holder with no edge receiver can be used as the lens holder. In other words, it is possible to use a lens holder that has no annular protruding part capable of making contact with the edge (outer peripheral end surface) of the lens in the outer peripheral edge of the lens-retaining surface.

According to the present invention, a lens shaped with no edge can be mounted between the lens holder and the lens-processing dish in a centered state, without the need for an operation of affixing the lens in a centered state on the lens-retaining surface of the lens holder. In this case, if the outside-diameter dimension of the lens holder is smaller than the outside-diameter dimension of the lens to be processed, a lens shaped with no edge can be centered in the same manner as a lens with an edge.

Next, a lens-processing method using the spherical center-type processing machine of the present invention is characterized by comprising:

a lens-centering step of mounting the lens between the lens-retaining surface and the lens-processing dish through the lens-centering method described above;

a lens-retaining step of retaining the centered lens on the lens-retaining surface by vacuum chucking; and a lens-processing step of pressing the spherical lens surface (the second spherical lens surface) of the lens chucked to the lens-retaining surface with a processing pressing force against the lens-processing surface, causing the lens-processing dish in this state to rotate at a prescribed processing rotational speed about the rotational axis line and to oscillate at a prescribed processing oscillation angle about the spherical center of the processing surface, and performing processing on the spherical lens surface (the second spherical lens surface) of the lens.

In the lens-processing step of the lens-processing method of the present invention, the precisely centered lens is mounted between the lens holder and the lens-processing dish, and the lens is retained in the centered position by vacuum chucking. Consequently, the spherical lens surface can be processed to a perfect sphere with precision.

In the lens-retaining step, it is preferable that the vacuum chucking pressure for retaining the lens on the lens-retaining surface be regulated in accordance with the shape of the lens, and in the processing step, it is preferable that the vacuum chucking pressure be regulated in accordance with the progress of processing on the spherical lens surface (the second spherical lens surface). Deformation of the lens chucked on the lens-retaining surface can be suppressed by regulating the vacuum chucking pressure. The spherical lens surface (the second spherical lens surface) can thereby be processed into a perfect sphere with precision.

Next, the spherical center-type processing machine of the present invention is characterized by comprising:

a lens holder having a lens-retaining surface;

a lens-processing dish having a lens-processing surface capable of facing the lens-retaining surface;

a movement mechanism for relatively moving the lens holder in a direction along the center axis line of the lens holder, relative to the lens-processing dish;

a vacuum chucking mechanism for vacuum-chucking the lens to be processed to a lens-retaining surface of the lens holder;

a rotation mechanism for causing the lens-processing dish to rotate about a rotational axis line passing through the center of the lens-processing surface and the spherical center of the lens-processing surface;

an oscillation mechanism for causing the lens-processing dish to oscillate about the spherical center positioned on the center axis line as the center of oscillation; and a controller for drivably controlling the movement mechanism, the vacuum chucking mechanism, the rotation mechanism, and the oscillation mechanism;

the controller performing the action of centering the lens to be processed, the action of retaining the lens on the lens holder, and the processing action of the lens using the lens-processing method described above.

A lens holder with no edge receiver can be used as the lens holder. In this case, the outside-diameter dimension of the lens-retaining surface is preferably smaller than the outside-diameter dimension of the lens to be processed.

MODE FOR CARRYING OUT THE INVENTION

An embodiment of a spherical center-type processing machine to which the present invention is applied is described below with reference to the drawings.

(Spherical Center-Type Processing Machine)

Figure 1:
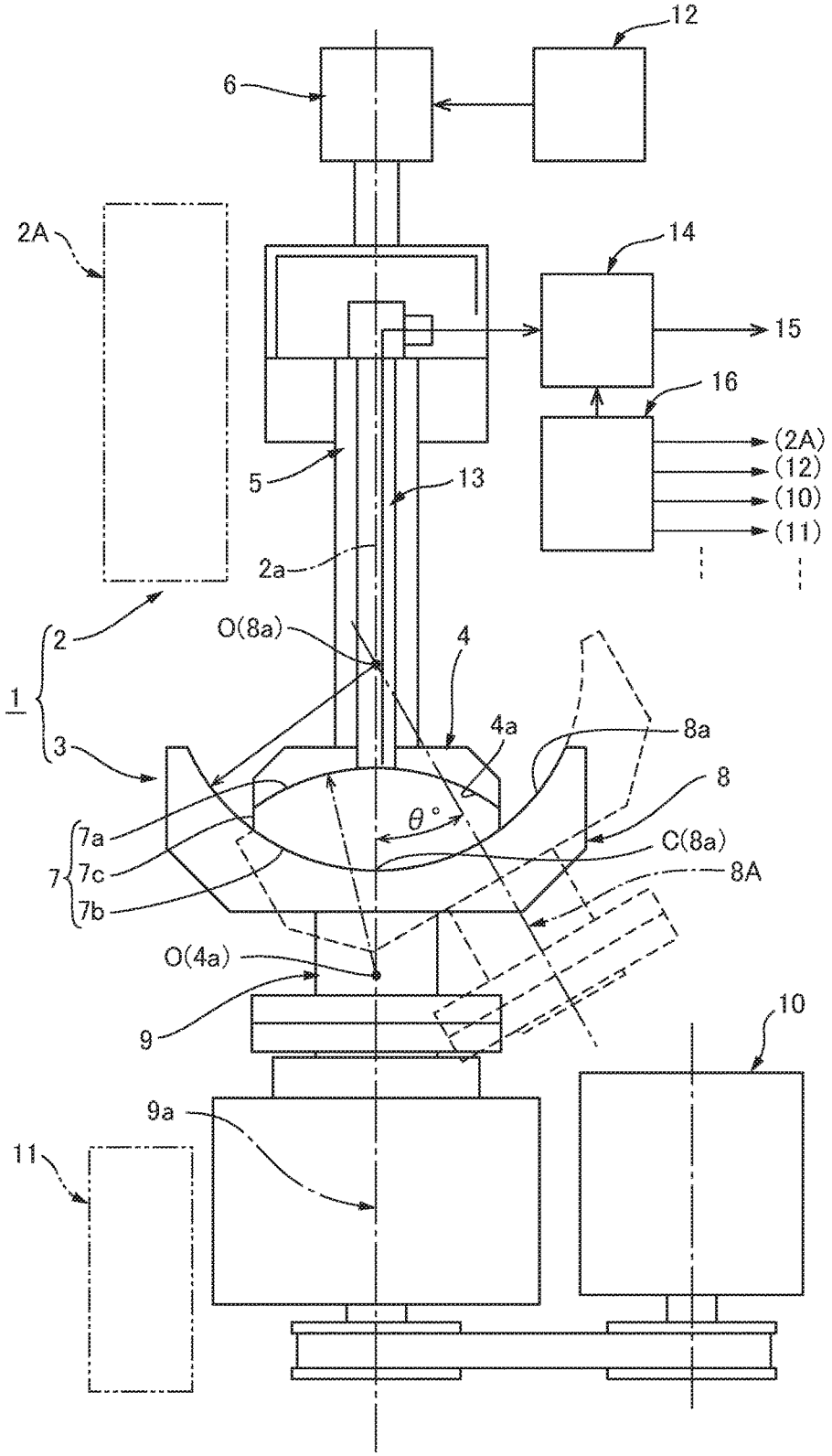
FIG. 1 is a schematic configuration diagram showing an example of a spherical center-type processing machine for processing a spherical lens surface using the method of the present invention.

FIG. 1 is a schematic configuration diagram showing a spherical center-type lens processing machine according to an embodiment of the present invention. A spherical center-type lens-processing machine 1 comprises an upper unit 2 and a lower unit 3. The upper unit 2 is capable of relative movement, in directions toward and away from the lower unit 3 along a unit center axis line 2*a*, and is raised and lowered by a movement mechanism 2A (raising/lowering mechanism) shown by the imaginary lines. The upper unit 2 comprises a lens holder 4 oriented downward. The lens holder 4 is attached to the lower end of a lens-pressurizing shaft 5, and is capable of being pressurized by a pressurizing cylinder 6 in the direction of the unit center axis line 2*a* while being oriented downward.

The lens holder 4, being a lens holder with no edge receiver, is not provided with an edge receiver that protrudes in an annular shape from the outer peripheral edge of a downward-oriented lens-retaining surface 4*a*. The lens-retaining surface 4*a* has a concave spherical surface shape, and the spherical center O (4*a*) thereof is positioned on the unit center axis line 2*a*. A lens material 7 (referred to below simply as the "lens 7") to be processed (to be precision-ground or to be polished) can be retained in the lens-retaining surface 4*a*.

The lens 7 to be processed is either a lens material made of a press-molded article, a roughly ground lens material obtained by performing rough grinding on a columnar lens material obtained by cutting a round-rod-shaped lens material. A first spherical lens surface 7*a* and a second spherical lens surface 7*b*, which have roughly spherical surface shapes obtained by rough grinding, are formed in both surfaces of the lens 7, and an edge 7*c* (circular outer peripheral end surface) of constant width is fashioned in the outer peripheral portion of the lens.

The lower unit 3 is provided with a lens-processing dish (dish-shaped grindstone) 8 oriented upward, and a concave spherical-surface-shaped lens-processing surface (grindstone surface) 8*a* provided with abrasive diamond grains is formed in the lens-processing dish 8. The spherical center O (8*a*) of the lens-processing surface 8*a* is positioned on the unit center axis line 2*a*. The second spherical lens surface 7*b*, which is a to-be-ground surface of the lens 7 retained on the upper unit 2 side, is pushed against the lens-processing surface 8*a*.

The lens-processing dish 8 is coaxially secured to the upper end of a spindle shaft 9. The spindle shaft 9 is rotatably driven about a center axis line 9*a* by a spindle motor 10. The lens-processing dish 8 and the mechanism (the spindle shaft 9 and spindle motor 10) for causing the dish to rotate are supported by an oscillation mechanism 11 shown by imaginary lines. The oscillation mechanism 11 is able to make the lens-processing dish 8 oscillate in a set oscillation direction, at a set processing radius R, and a set processing oscillation angle θ about the spherical center O (8*a*) of the lens-processing surface 8*a*, which is positioned on the unit center axis line 2*a*, as the center of oscillation.

The pressurizing force produced by the pressurizing cylinder 6 in the upper unit 2 can be regulated by a regulator 12.

In the present example, it is possible to switch between at least a pressurizing force for centering and a greater pressurizing force for processing. An actuating fluid having a set pressure is supplied by the regulator 12 to the pressurizing cylinder 6.

A vacuum suction hole 13 is formed coaxially in the lens-pressurizing shaft 5, and the lower end of this vacuum suction hole 13 opens in the center of the lens-retaining surface 4*a* of the lens holder 4. The upper end of the vacuum suction hole 13 is connected to a vacuum source 15 via a vacuum regulator 14. A lens vacuum suction mechanism is configured by the vacuum suction hole 13 and the vacuum regulator 14, and the lens material 7 can be retained by vacuum chucking on the lens-retaining surface 4*a* of the lens holder 4 by the vacuum suction force regulated by the vacuum regulator 14.

Next, a controller 16, which performs drive control for the various components, regulates the pressurizing force via the regulator 12 and regulates vacuum chucking force via the vacuum regulator 14. The controller also controls the speed at which the lens-processing dish 8 is caused to rotate by the spindle motor 10, and the angle at which the lens-processing dish 8 is caused to oscillate by the oscillation mechanism 11. Furthermore, the controller monitors the processed amount (precision-grinding processing amount or polishing processing amount) of the lens material 7 through the use of a length measuring instrument or another measurement device (not shown), and controls the pressurizing force produced by the pressurizing cylinder 6 via the regulator 12 and the vacuum chucking force on the lens material 7 in the lens holder 4 in accordance with this processing amount.

(Centering/Processing Action)

Figure 2:
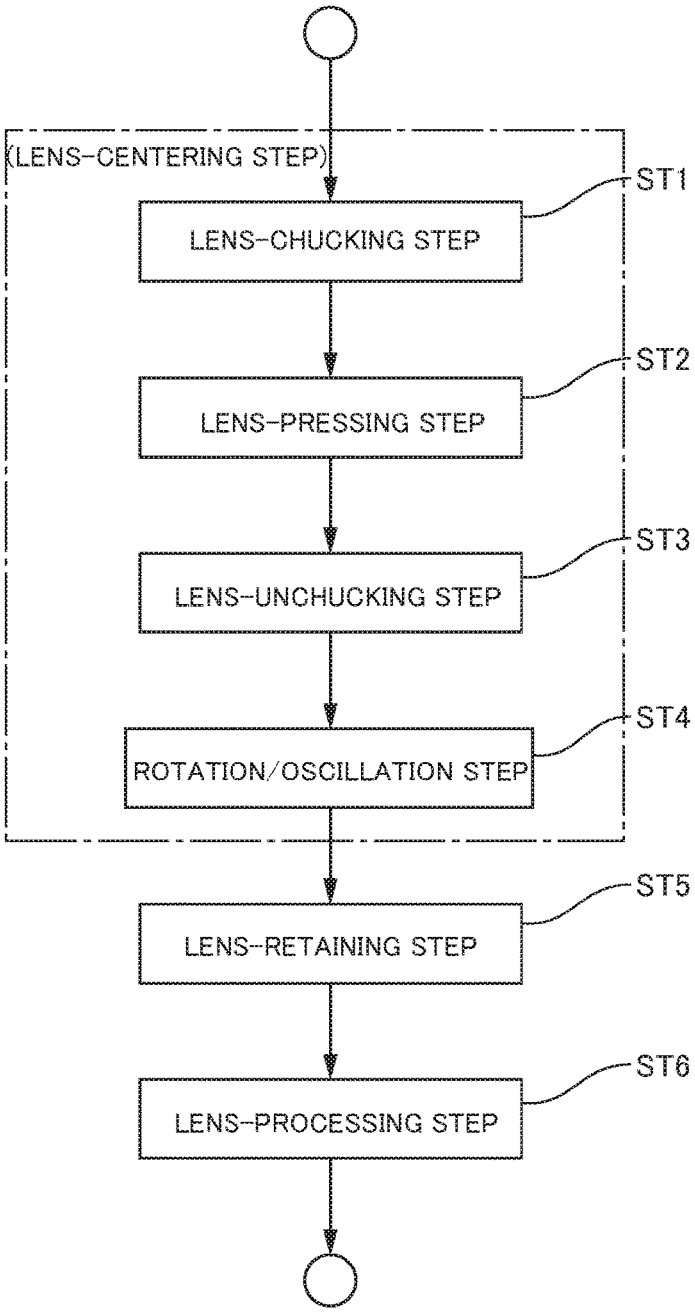
FIG. 2 is a schematic flowchart showing the processing action of the spherical center-type processing machine of FIG. 1.

FIG. 2 is a schematic flowchart showing the action of centering and processing a spherical lens, using the spherical center-type lens-processing machine 1. Referring to FIGS. 1 and 2 for this description, first, the upper unit 2 and the lower unit 3 are positioned coaxially, and the upper unit 2 is in a position of having been retracted upward from the position shown by the solid lines in FIG. 1. In this state, for example, a robot hand or another conveying mechanism (not shown) is used to convey the lens 7 to be processed to a position directly underneath the lens holder 4, and the lens 7 is chucked with a prescribed vacuum chucking force to the lens-retaining surface 4*a* of the lens holder 4 (lens-chucking step ST1). The lens-retaining surface 4*a* of the lens holder 4 in this embodiment has a spherical surface shape corresponding to the first spherical lens surface 7*a* of the rough-ground lens 7.

After the lens 7 has been retained by chucking in the lens holder 4, the upper unit 2 is lowered by the movement mechanism (raising/lowering mechanism) 2A, the lens 7 chucked on the lens-retaining surface 4*a* is lowered toward the lens-processing dish 8 waiting directly below, the second spherical lens surface 7*b* of the lens 7 is pressed against the lens-processing surface 8*a* having a corresponding spherical surface shape, and the lens 7 is held between the lens-processing dish 8 and the lens holder 4. A pressed state is brought about, in which the pressurizing cylinder 6 causes the lens holder 4 to press the lens 7 against the lens-processing dish 8 at a prescribed pressing force (lens-pressing step ST2). The state shown in FIG. 1 is thereby brought about.

After the lens 7 has been brought into a pressed state, the lens 7 is temporarily unchucked from the lens-retaining surface 4*a* (lens-unchucking step ST3).

The lens-processing dish 8 is then rotated at a prescribed rotational speed by the spindle motor 10 while the prescribed pressed state is maintained. The lens-processing dish 8 is rotated at a prescribed rotational speed about a rotation axis 8A that passes through the center C (8*a*) of the lens-processing surface 8*a* and the spherical center O (8*a*) of the lens-processing surface 8*a*. At the same time, the oscillation mechanism 11 is driven, causing the lens-processing dish 8 to oscillate at a prescribed oscillation angle in a prescribed direction about the spherical center O (8*a*) of the lens-processing surface 8*a* as the center of oscillating action (rotation/oscillation step ST4).

The spherical center of the first spherical lens surface 7*a* of the lens 7 can thereby be guided to the spherical center O (4*a*) of the lens-retaining surface 4*a* of the lens holder 4. At the same time, the spherical center of the second spherical lens surface 7*b* can be guided to the spherical center O (8*a*) of the lens-processing surface 8*a* of the lens-processing dish 8.

The pressing force produced by the pressurizing cylinder 6 in this embodiment is set to a pressure less than the pressing force for processing during the processing of the second spherical lens surface 7*b* of the lens 7. The pressing force is preferably set to a value within a range of ⅕ to ½ of the pressing force for processing. The rotational speed of the lens-processing dish 8 is also set to a speed slower than the rotational speed for processing during the processing of the second spherical lens surface 7*b*. The rotational speed is preferably set to a value within a range of 100 rpm to 50 rpm. Furthermore, the oscillation angle of the lens-processing dish 8 is set to an angle smaller than the oscillation angle for processing during the processing of the second spherical lens surface 7*b*. The oscillation angle is preferably set to a value within a range of 1/30 to 1/10 of the opening angle of the second spherical lens surface 7*b* from the unit center axis line 2*a*.

The vacuum-chucking state is removed from between the lens holder and the lens-processing dish 8, and the lens 7 is retained with little pressing force. Consequently, the lens is able to move slightly (rotate and oscillate) along with the slow rotation and slight oscillation of the lens-processing dish 8. As the lens 7 slightly moves along with the rotation and oscillation of the lens-processing dish 8, the first spherical lens surface 7*a* slightly slides along the lens-retaining surface 4*a* having a corresponding spherical surface shape, and the second spherical lens surface 7*b* slightly slides along the lens-processing surface 8*a* having a corresponding spherical surface shape. As a result, the lens material 7 is guided along the lens-retaining surface 4*a* and the lens-processing surface 8*a* to a mechanically stable position while repeatedly sliding in slight amounts. In other words, a centered state is brought about in which the straight line joining the spherical centers of the spherical lens surfaces 7*a*, 7*b* on both sides of the lens 7 to be processed coincides with the straight line joining the spherical center O (4*a*) of the lens-retaining surface 4*a* and the spherical center O (8*a*) of the lens-processing surface 8*a*.

After the action for centering the lens material 7 (the centering steps in steps ST1 to ST4) has ended, the lens 7 is again retained by vacuum chucking on the lens-retaining surface 4*a* of the lens holder 4 while continuing to be made to rotate and Next, the pressurizing force produced by the pressurizing cylinder 6 is increased, and a state is brought about in which the chucked lens 7 is pressed against the lens-processing dish 8 at a pressing force for processing greater than the pressing force during centering. In this state, the rotational speed of the lens-processing dish 8 is raised to rotate the lens-processing dish 8 at a rotational speed for processing, and the lens-processing dish 8 is made to oscillate about the spherical center (8*a*) of the lens-processing surface 8*a* as the center, at an oscillation angle for processing greater than the oscillation angle during centering. Processing (rough grinding or polishing) is thereby performed on the second spherical lens surface 7*b* pressed against the lens-processing surface 8*a* of the lens-processing dish 8 (lens-processing step ST6).

In the lens-retaining step ST5 and the lens-processing step st6, the vacuum chucking force of the lens 7 is preferably regulated in accordance with the shape, and particularly the thickness dimension, of the lens 7 to be processed. Warping and other deformation in the lens 7 can thereby be prevented, by appropriately setting the vacuum chucking force.

In the lens-processing step ST6, the amount by which the lens material 7 is processed (rough grinding amount or polishing amount) is managed by the controller 16, and the controller 16 regulates the vacuum chucking force in accordance with the processing amount. For example, warping and other deformation in the lens 7 due to the vacuum chucking force can be prevented or suppressed by gradually reducing the vacuum chucking force as the processing advances and the lens thickness decreases. Spherical surface processing can thereby be performed with precision.

(Edgeless Lens Processing)

The above example was of a case in which an edged lens 7 was processed by the spherical center-type lens-processing machine 1. The present invention can be similarly applied to the processing of an edgeless lens.

Figure 3:
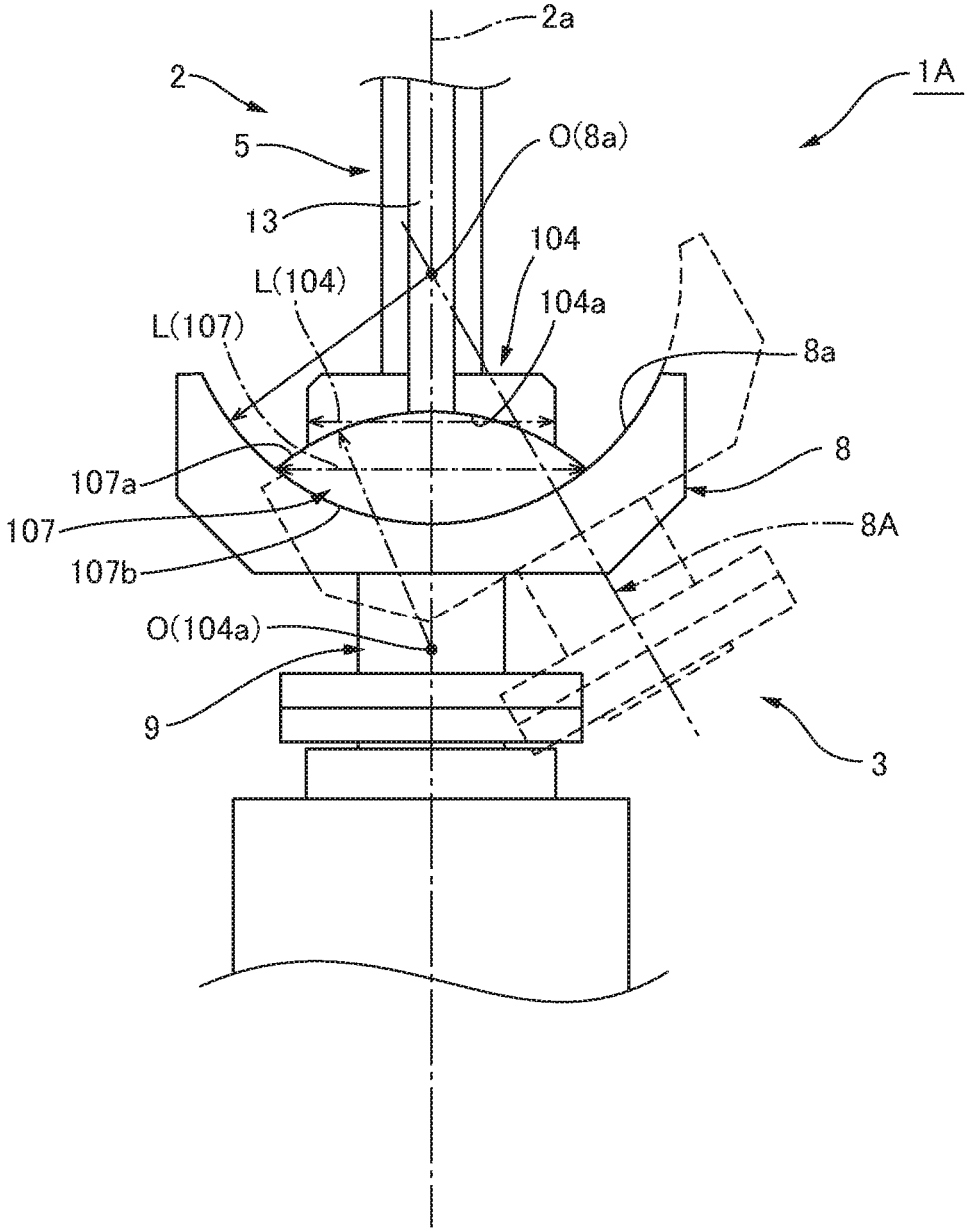
FIG. 3 is a partial configuration diagram showing an example of a spherical center-type processing machine an edgeless lens material.

FIG. 3 is a partial configuration diagram showing a case in which a spherical center-type lens-processing machine is used to process an edgeless lens 107. The spherical center-type lens-processing machine 1A has the same configuration as the spherical center-type lens-processing machine 1 described above, except that the shape of the lens holder 104 is different. Consequently, in FIG. 3, the same symbols are assigned to regions corresponding to the components of FIG. 1, and descriptions of these regions are omitted.

In the present example, the outer peripheral edges of the first spherical lens surface 107*a* and second spherical lens surface 107*b* of the lens 107 have mutually coinciding cross-sectional shapes. The lens-retaining surface 104*a* of the lens holder 104 has an outside-diameter dimension L (104) one size smaller than the outside-diameter dimension L (107) of the lens 107 to be processed. Using a lens holder 104 of this shape, the edgeless lens 107 can be processed in the same manner as the edged lens 7.

(Operative Effects of Embodiment)

As described above, in the present embodiment, the lens-processing dish 8 is slowly rotated in the initial stage of processing, and is simultaneously oscillated slightly. A state is thereby brought about in which the spherical center of the first spherical lens surface 7*a* on the lens holder 4 side is positioned in the spherical center O (4*a*) of the lens holder 4, the spherical center of the second spherical lens surface 7*b* on the lens-processing dish 8 side is positioned in the spherical center O (8*a*) of the lens-processing dish 8, and these spherical centers are positioned on a straight line (lens centered state).

During processing, the lens 7 is vacuum-chucked to the lens holder 4, whereby the lens 7 being processed does not move laterally, and the lens 7 is processed while remaining centered. Deformation of the lens 7 is also prevented or suppressed by varying the vacuum chucking force during processing. Consequently, the spherical lens surface 7*b* can be processed with precision to a perfectly spherical surface.

As a result, the spherical lens surfaces on both sides of the lens 7 after processing are processed with precision to perfect spheres, and the spherical centers thereof are positioned on a straight line. Consequently, the spherical lens surfaces can be processed with precision.

Because there is no need to center the lens 7 using a lens holder with an edge receiver, it is possible to use a lens holder having a smaller outside-diameter dimension than the lens to be processed.

Furthermore, there is no need to affix the lens in the lens holder in order to process an edgeless lens, and centering and processing can be performed with the lens retained in the lens holder by vacuum chucking. Consequently, an edgeless lens can be processed more efficiently and with greater precision than in conventional practice.

(Other Embodiments)

Figure 4:
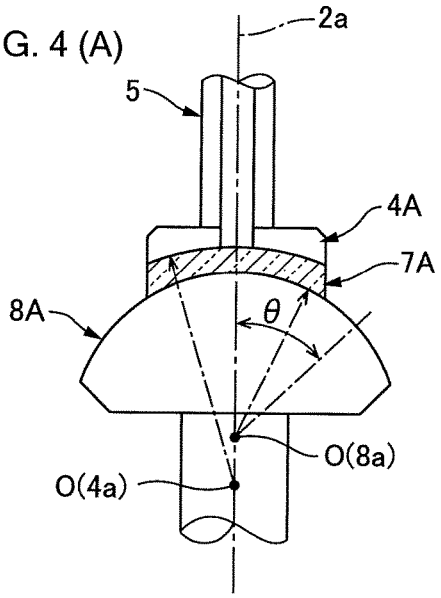
FIGS. 4(A)-(D) are an explanatory diagram showing an applied example of the present invention.
Figure 4:
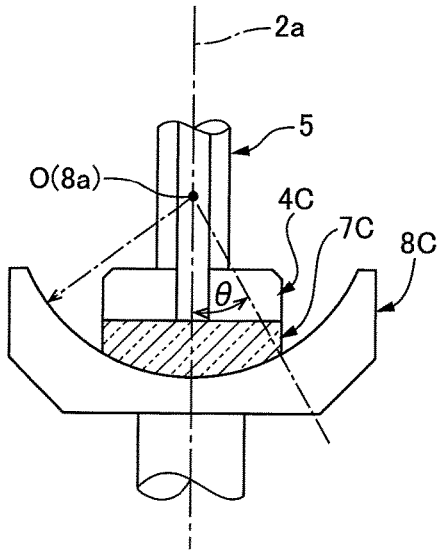
Figure 4:
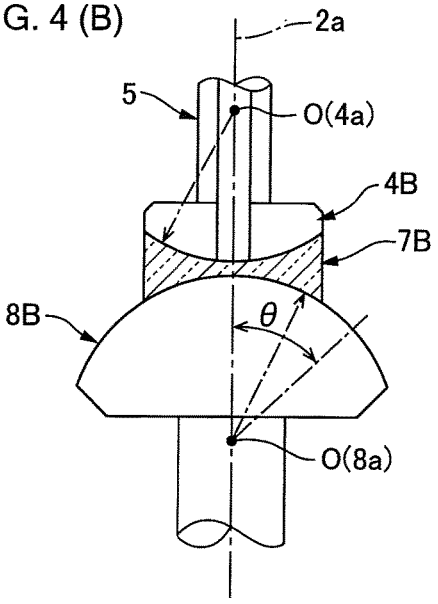
Figure 4:
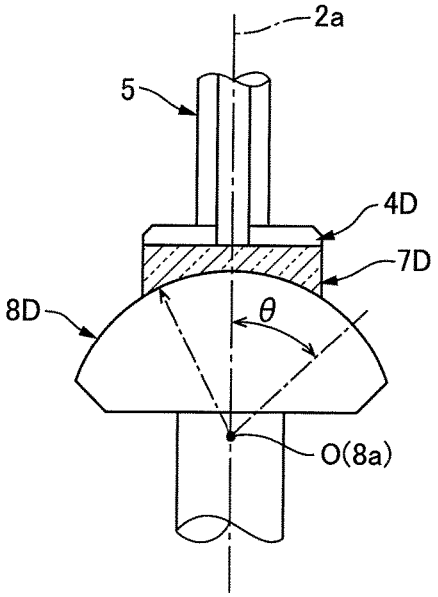

The lens 7 to be processed in the above embodiment is a spherical surface lens in which spherical lens surfaces 7*a*, 7*b* are formed in both sides. The lens 7 to be processed can have various shapes. Examples include a lens 7A having a convex spherical surface on one side and a concave spherical surface on the other side, a lens 7B having concave spherical surfaces on both sides, a lens 7C having a convex spherical surface on one side and a flat surface on the other side, and a lens 7D having a concave spherical surface on one side and a flat surface on the other side, as shown in FIGS. 4(*a*), (*b*), (*c*), and (*d*). Lens holders 4A, 4B, 4C, 4D and lens-processing dishes 8A, 8B, 8C, 8D are used, which are suited to the lens surface shapes of the lenses 7 to be processed. The present invention can be applied to the action of centering lenses of such various shapes, as shall be apparent.

During the centering step of the above embodiment, in cases such as a nearly flat lens surface shape with a small curvature in the spherical lens surface, sometimes the lens does not easily move even when the lens-processing dish rotates and oscillates. In this case, a water film is preferably formed on the lens surface that makes contact with the lens-processing surface of the lens-processing dish in order to make the lens move more easily. For example, with the lens sandwiched between the lens holder and the lens-processing dish, a coolant liquid (grinding liquid) is discharged from near the center of the lens-processing surface of the lens-processing dish. A liquid film is thereby formed on the lens surface that is in contact with the lens-processing surface, the lens moves easily, and the lens is reliably centered.

As a method of increasing the centering effect, such as shortening the time of the centering step, air may be continuously discharged from the lens holder side. For example, with the lens sandwiched between the lens holder and the lens-processing dish, the lens-processing dish is made to rotate and oscillate and the lens is centered while air is continuously discharged from vacuum chucking hole opened in the center of the lens-retaining surface of the lens holder.

Furthermore, water films can be formed on the lens surfaces, and the lens-centering action can be performed while air is continuously discharged. Doing so makes it possible to center the lens more efficiently in a shorter time.

The invention claimed is:

1. A lens-centering method for mounting a lens in a centered state between a lens holder and a lens-processing dish of a spherical center-type processing machine in order to precision-grind or polish a spherical lens surface of the lens, said lens centering method comprising:

a lens-chucking step of vacuum-chucking the lens to the lens holder;

a lens-pressing step of pressing the spherical lens surface of the lens with a prescribed pressing force to a lens-processing surface of the lens-processing dish, the lens-processing surface having a spherical-surface shape corresponding to the spherical lens surface;

a lens-unchucking step of unchucking of the lens; and a rotation/oscillation step of guiding a spherical center of the spherical lens surface to a spherical center of the lens-processing surface by rotating the lens-processing dish, with the lens pressed against the dish at said pressing force, at a prescribed rotational speed about a rotational axis line passing through a center of the lens-processing surface and a spherical center positioned on a center axis line of the lens holder in the lens-processing surface, and causing the lens-processing dish to oscillate at a prescribed oscillation angle in a prescribed direction about the spherical center as a center of oscillating action.

2. The lens-centering method of the spherical center-type processing machine according to claim 1, wherein the lens is formed with a first spherical lens surface on one surface thereof and a second spherical lens surface on another surface thereof, and the second spherical lens surface is the spherical lens surface to which a precision-grinding process or a polishing process is applied;

in the lens-chucking step, vacuum-sucking the first spherical lens surface of the lens to a lens-retaining surface of the lens holder, the lens-retaining surface having a spherical-surface shape corresponding to the first spherical lens surface;

in the lens-pressing step, pressing the second spherical lens surface of the lens, with a prescribed pressing force, to the lens-processing surface of the lens-processing dish, the lens-processing surface having a spherical-surface shape corresponding to the second spherical lens surface; and in the rotation/oscillation step, guiding the spherical center of the first spherical lens surface to the spherical center of the lens-retaining surface and guiding the spherical center of the second spherical lens surface to the spherical center of the lens-processing surface, by rotating the lens-processing dish at a prescribed rotational speed about a rotational axis line passing through the center of the lens-processing surface and the spherical center of the lens-processing surface, and causing the lens-processing dish to oscillate at a prescribed oscillation angle in a prescribed direction about the spherical center of the lens-processing surface as the center of oscillating action.

3. The lens-centering method of the spherical center-type processing machine according to claim 1, wherein in the rotation/oscillation step, the pressing force is less than a processing pressing force during precision grinding or polishing of the spherical lens surface of the lens, the rotational speed is slower than a processing rotational speed during the precision grinding or polishing of the spherical lens surface, and the oscillation angle is less than a processing oscillation angle during the precision grinding or polishing of the spherical lens surface.

4. The lens-centering method of the spherical center-type processing machine according to claim 3, wherein the pressing force is ⅕ to ½ of the processing pressing force, the rotational speed is 100 to 500 rpm, and the oscillation angle is 1/30 to 1/10 of an opening angle of the spherical lens surface from the center axis line.

5. The lens-centering method of the spherical center-type processing machine according to claim 1, wherein the lens holder is a lens holder with no edge receiver.

6. The lens-centering method of the spherical center-type processing machine according to claim 5, wherein the lens is a lens shaped with no edge, and an outer diameter dimension of the lens holder is smaller than an outer diameter dimension of the lens.

7. A lens-processing method using a spherical center-type processing machine, the lens-processing method comprising:

a lens-centering step of mounting a lens between a lens holder and a lens-processing dish through the lens-centering method according to claim 1;

a lens-retaining step of retaining the centered lens on the lens-retaining holder by vacuum chucking; and a lens-processing step of pressing the spherical lens surface of the lens with a prescribed processing pressing force against a lens-processing surface of the lens-processing dish, and, while maintaining the pressing state, causing the lens-processing dish to rotate at a prescribed processing rotational speed about a rotational axis line and to oscillate at a prescribed processing oscillation angle about a spherical center of the lens-processing surface.

8. The lens-processing method using the spherical center-type processing machine according to claim 7, wherein in the lens-retaining step, regulating a vacuum chucking pressure for retaining the lens on the lens-retaining holder in accordance with a shape of the lens; and in the lens-processing step, regulating the vacuum chucking pressure accordance with progress of processing on the spherical lens surface.

9. A spherical center-type processing machine comprising:

a lens holder having a lens-retaining surface;

a lens-processing dish having a lens-processing surface capable of facing the lens-retaining surface;

a movement mechanism for relatively moving the lens holder in a direction along a center axis line of the lens holder, relative to the lens-processing dish;

a vacuum chucking mechanism for vacuum-chucking the lens to be processed to a lens-retaining surface of the lens holder;

a rotation mechanism for causing the lens-processing dish to rotate about a rotational axis line passing through a center of the lens-processing surface and a spherical center of the lens-processing surface;

an oscillation mechanism for causing the lens-processing dish to oscillate about the spherical center positioned on the center axis line as a center of oscillation; and a controller for drivably controlling the movement mechanism, the vacuum chucking mechanism, the rotation mechanism, and the oscillation mechanism;

the controller performing an action of centering the lens to be processed, an action of retaining the lens on the lens holder, and a processing action of the lens according to the lens-processing method of claim 7.

10. The spherical center-type processing machine according to claim 9, wherein the lens holder is a lens holder with no edge receiver, and an outside-diameter dimension of the lens holder is smaller than an outside-diameter dimension of the lens to be processed.

* * * * *